United States Patent [19]

Torelli et al.

[11] Patent Number: 4,782,530

[45] Date of Patent: Nov. 1, 1988

[54] NON-RECURSIVE SYSTEM FOR EXPANDING THE STEREO BASE OF STEREOPHONIC ACOUSTIC DIFFUSION APPARATUS

[75] Inventors: Guido Torelli, S. Alessio; Alejandro De La Plaza, Bergamo, both of Italy

[73] Assignee: SGS Microelettronica SpA, Catania, Italy

[21] Appl. No.: 904,392

[22] Filed: Sep. 8, 1986

[30] Foreign Application Priority Data

Sep. 12, 1985 [IT] Italy ..... 22114 A/85

[51] Int. Cl.[4] ..... H04S 1/00

[52] U.S. Cl. ..... 381/1

[58] Field of Search ..... 381/1, 17, 18

[56] References Cited

U.S. PATENT DOCUMENTS 4,355,203 10/1982 Cohen ..... 381/1

4,394,536 7/1983 Shima et al. ..... 381/1

FOREIGN PATENT DOCUMENTS 56-006600 1/1981 Japan ..... 381/1

56-106500 8/1981 Japan ..... 381/1

OTHER PUBLICATIONS

R. Gregorian, G. C. Temes: "Analog MOS Integrated Circuits for Signal Processing", John Wiley & Sons, N.Y. (title page, index pages, pp. 254–257, pp. 389–391, pp. 502–505).

P. R. Gray and R. G. Meyer: "MOS Operational Amplifier Design—A Tutorial Overview", in IEEE Journal of Solid-State Circuits, vol. SC-17, No. 6, Dec. 1982.

R. Castello & P. R. Gray: "A High-Performance Micropower Switched-Capacitor Filer", in IEEE Journal of Solid-State Circuits", vol. SC-20, No. 6, Dec. 1985.

M. Banu, Y. Tsuividis: "Fully Integrated Active RC Filters in MOS Technology", in IEEE Journal of Solid-State Circuits", vol. SC-18, No. 6, Dec. 1983.

M. S. Ghausi and K. R. Laker: "Modern Filter Design—Active and Switched Capacitor", Prentice-Hall, Inc., Englewood Cliffs, NJ (title page and index).

P. A. Allen & E. Sanchez-Sinencia: "Switched Capacitor Circuits", Van Nostrand Reinhold Co., Inc. (title page and index).

A. S. Sedra & K. C. Smith: "Microelectronic Circuits", Holt, Rinehart and Winston (title page, index and pp. 642–648).

A. B. Grebene: "Bipolar and MOS Analog Integrated Circuit Design", John Wiley & Sons (title page, index pages and pp. 703–712).

*Primary Examiner*—Forester W. Isen

*Attorney, Agent, or Firm*—Wenderoth, Lind & Ponack

[57] ABSTRACT

A first and a second input signals, composing a stereophonic pair, are amplified in respective channels, added by adder means in a desired phase relationship, chosen between completely in phase and 180° out of phase, and the sum signal thus produced is processed by a transfer bloc having a desired transfer function, and is superimposed on the signal in the first channel with opposite phase, and is then superimposed on the signal in the second channel with a 180° out of phase or in phase relationship, according to whether the input signals are added respectively in phase or with opposite phase.

4 Claims, 2 Drawing Sheets

NON-RECURSIVE SYSTEM FOR EXPANDING THE STEREO BASE OF STEREOPHONIC ACOUSTIC DIFFUSION APPARATUS

BACKGROUND OF THE INVENTION

Field of the invention

The present invention relates to a non-recursive system for expanding the stereo base of acoustic stereophonic diffusion apparatus.

As is known when the distance between the two loudspeakers of an acoustic stereophonic diffusion apparatus is relatively small (e.g. 60–70 cm.) the stereophonic effect is almost imperceptible, or anyway inadequate, for listeners positioned some distance away from the loudspeakers. In order to simulate the effect that would occur with speakers mutually set further apart, the processing is therefore known of the input acoustic signals of the system, to improve their stereophonic characteristics, thus performing the so-called "expansion of the stereo base".

The conventional method for achieving said processing is to use a "recursive" technique, in which a 180° out of phase crossed crosstalk is created between the two acoustic channels (left and right), usually by subtracting the output signal of each channel from the input signal of the other channel, with an appropriate amplification or attenuation of said subtracted signals. In practice such crosstalk is imposed only on a part of the total band of the signal, in order to avoid disadvantages related to the propagation of acoustic waves and to the physiology of listening, which are well known to those skilled in the art.

Therefore, the crossing paths of the signals fed back to the input comprise band pass filters, and generally correction filters are included in the two direct channels as well. Both the two direct channels and the crossed crosstalk paths can therefore be considered as filters (active or passive), and when, in the continuation of the description, amplifiers will be mentioned, in any case it will be meant that the provided amplification may also comprise a desired filtering out.

Systems of the abovementioned kind are described, as an example, in "DIGIT 2000 - VLSI Digital TV System", ITT Semiconductors, Publication Order No. 6251-190-2E, page 6.13, August 1982, or in "The German 2-Carrier System for Terrestrial TV-Sound Transmission Systems and Integrated Circuits for 'High-Quality' TV Receivers", by U. Buhse, in *IEEE Transactions on Consumer Electronics,* Vol. CE-28, No. 4, page 489, November 1982.

Such known solutions, since they are all of the recursive type, require delicate design and tuning, and may give rise to instability. Furthermore, they require four amplifier (and/or filtering) blocs, two of which for the direct channels (i.e. for driving the downstream stages of the system), and the other two for the signals being fedback to provide the expansion. The complexity of such blocs depends on the complexity of the filtering functions which it is desired to obtain.

SUMMARY OF THE INVENTION

The main object of the invention is to provide a system for expanding the stereo base in stereophonic signals, for stereophonic acoustic diffusion apparatus, which is not of the recursive type, and which is more economical to provide within an integrated circuit.

Another object is to provide such a non-recursive expanding system in which the expansion of the stereo base is programmable with greater simplicity than in known recursive circuits.

According to the invention, the above objects, as well as yet other objects which will better appear hereinafter, are achieved by a system for expanding the stereo base for stereophonic acoustic diffusion apparatus, in which a first and a second input signals, composing a stereophonic pair, are amplified in respective direct amplifier means to obtain a first and a second output signals, characterized in that said input signals are added by adder means, in a phase relationship, chosen between completely in phase and 180° out of phase, the sum signal from said adder means being processed by a transfer bloc having a given transfer function, and being superimposed on said first output signal with opposite phase, and being then superimposed on said second output signal in phase or 180° out of phase therewith, depending on whether said input signals are added respectively in phase or 180° out of phase.

BRIEF DESCRIPTION OF THE DRAWINGS

A preferred embodiment of the invention will now be described, by way of a non-limitative example, with reference to the accompanying drawings, where.

DETAILED DESCRIPTION OF THE PREFERRED EMBODIMENTS

The invention arises from the observation that the stereophonic information of an acoustic signal is completely contained in the differential part of the signals of the two channels, whereas their common part only contains monoaural information. So, as an example, in the case of a monoaural acoustic signal (e.g., the voice of a speaker placed at the center of the transmission stand), the two signals, left $V_L$ and right $V_R$, are both identical to a same value $V_i$:

$$V_L = V_i$$

$$V_R = V_i,$$

while in the case of a maximally stereophonic acoustic signal (e.g., the sound of an instrument located at one end of the stand) the two signals will be ideally:

$$V_L = V_i$$

$$V_R = O,$$

that is to say $$V_L = V_i/2 + V_i/2 \quad (1a)$$

$$V_R = V_i/2 - V_i/2 \quad (1b)$$

From these equations (1), it therefore turns out that a signal with a maximum stereophonic contents comprises a first common component, equal for amplitude and phase in the two channels, and a second differential part, equal for amplitude to the first but with opposite phase on the two channels. To expand the stereo base of the stereophonic signal, therefore, is equivalent to improving the differential part with respect to the common part.

Figure 1:
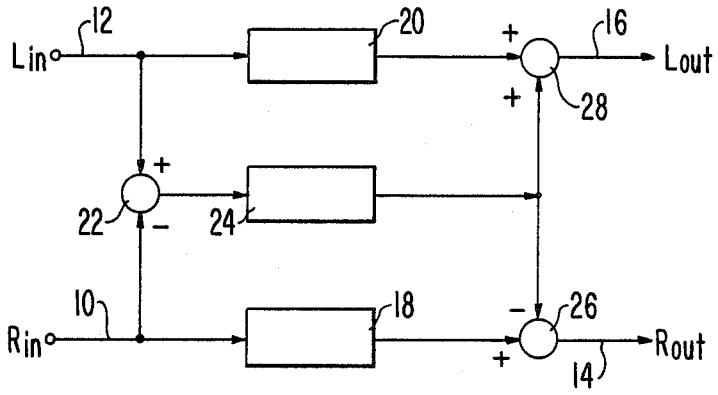
FIG. 1 is a bloc diagram of a first embodiment of a stereo base expanding system according to the invention.

This concept has been provided in a first embodiment of a non-recursive system for expanding the stereo base, according to the invention, illustrated in FIG. 1. The system comprises respective inputs 10 and 12 for the right and left input signals $R_{in}$ and $L_{in}$, constituting a stereophonic pair, and respective outputs 14 and 16 for the right and left output signals $R_{out}$ and $L_{out}$. In the right and left channels defined respectively between the right and left inputs and the right and left outputs, respective amplifiers 18 and 20 are connected, identical to each other, each having a gain B at the center of the band. As has already been specified above, the amplifiers 18 and 20 can include filtering functions, for example of the low-pass type, for attenuating the high tones.

The right and left input signals $R_{in}$ and $L_{in}$ are applied to linear combining means 22 suitable for providing the difference between said input signals, and said difference is applied to a transfer bloc 24, which comprises a band-pass filter, and which has a gain A at the center of the band. Since the value of the gain A of the bloc 24 can be even smaller than 1 (depending on the design parameters of the entire system), the transfer bloc 24 is generic, possibly reducing itself to a simple passive filtering network.

The output signal of the bloc 24 is applied, on one side, to subtracting means 26 inserted, series coupled, in the right channel, to be subtracted (or added in opposite phase) to the right output signal $R_{out}$; on the other side it is applied to adder means 28 inserted series coupled, to add itself (in phase) to the left output signal $L_{out}$.

By representing in mathematical terms the relations that the system of FIG. 1 forces between the input and output signals, the following expressions are finally obtained, wherein the various symbols have the meanings described above:

$$L_{out} = BL_{in} + A(L_{in} - R_{in}) \quad (2a)$$

$$R_{out} = BR_{in} - A(L_{in} - R_{in}) \quad (2b)$$

If, on the grounds of what has been described with reference to the equations (1), the signals $R_{in}$ and $L_{in}$ are expressed as follows:

$$L_{in} = C + D \quad (3a)$$

$$R_{in} = C - D \quad (3b)$$

where C is the common part and D is the differential part of the two signals, the equations (2) can be expressed as follows:

$$L_{out} = BC + (2A + B)D \quad (4a)$$

$$R_{out} = BC - (2A + B)D \quad (4b)$$

Since A and B, at least at the center of the band, have the same sign, the differential part D is amplified more than the common part, thus giving rise to the desired expansion of the stereo base.

Preferably, in the practical embodiment the value of the gain A of the bloc 24 is programmable, so as to allow the use of the same circuit in different applications, in which different expansions are required. This does not prevent the possibility of making the gains of the blocs 18, 20 programmable as well.

Figure 2:
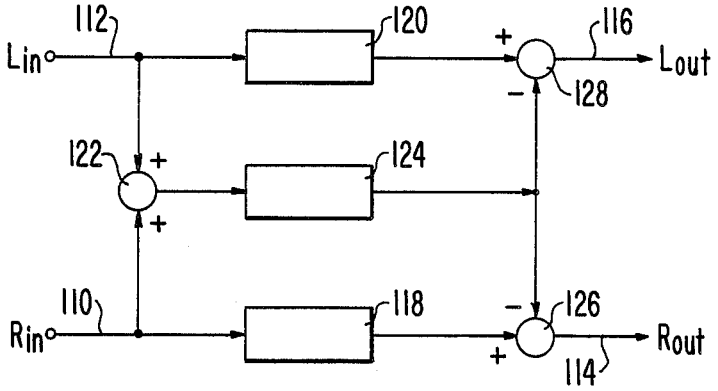
FIG. 2 is a bloc diagram of a second embodiment of a stereo base expanding system according to the invention.

The embodiment of the invention illustrated in FIG. 2, largely similar to the one of FIG. 1, bears the same reference numbers for the corresponding parts, increased by 100.

The second embodiment is different from the first one since the subtracting means 22 are replaced with adder means 122, and the adder means 28 on the left channel $L_{in}$ are replaced by subtracting means 128. All the other elements are substantially identical to the corresponding ones of FIG. 1, and the same remarks are valid concerning the amplifier and the filtering functions.

By obtaining the equations which relate the output signals to the differential and common parts of the input signals, in this case the following is obtained:

$$L_{out} = BL_{in} - A(L_{in} + R_{in})$$

$$R_{out} = BR_{in} - A(L_{in} + R_{in})$$

from which, with the same positions as before:

$$L_{out} = (B - 2A)C + BD$$

$$R_{out} = (B - 2A)C - BD$$

Similarly to the embodiment of FIG. 1, since A and B (at the center of the band) have the same sign, the amplification of the differential part is greater than the one of the common part (so long as $|A| < |B|$, and therefore the stereo base is expanded. Also in this case, the expansion can be made programmable in a particularly effective manner, by programming the gain of the transfer bloc 124.

Figure 3:
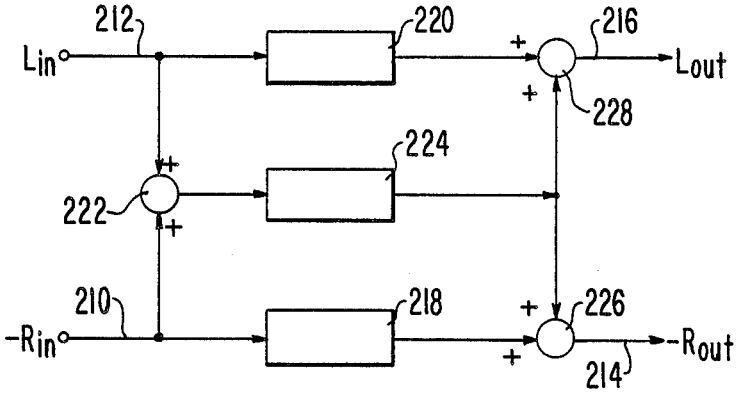
FIG. 3 is a bloc diagram of a third embodiment of a stereo base expanding system according to the invention.

The embodiment of FIG. 3, which is also composed of parts which are similar to the ones of FIG. 1, which therefore bear the same reference numerals increased by 200, is applicable when at least one of the input signals is available in inverted form and when it is furthermore acceptable to obtain one of the output signals inverted as well. In integrated circuits of the "fully differential" kind this often occurs without disadvantages.

In this embodiment the right input signal $R_{in}$ is applied in inverted form, while the left one $L_{in}$ is applied in non-inverted form. The two input signals, apart from being amplified (and/or filtered) in respective channels 218 and 220, are added in phase in an adder 222 to obtain a sum signal which, after processing in a transfer bloc 224, is again added in phase to the two channels, by means of adders 226 and 228. In other words, in this embodiment only adder means are employed, without any subtracting means. At the output, the signals $R_{out}$ and $L_{out}$ are obtained, respectively in inverted and not inverted form.

The relationships which relate the two output signals to the input ones are then:

$$L_{out} = BL_{in} + A(L_{in} - R_{in}) \quad (5a)$$

$$-R_{out} = -BR_{in} + A(L_{in} - R_{in}) \quad (5b)$$

from which, with the substitutions (3), the same relationships (4) are obtained which are valid for the first embodiment. It can be seen therefore that the third embodiment is fully equivalent to the first one, the function of the subtracting inputs being merely replaced by the use of the signal $R_{in}$ in inverted form.

Figure 4:
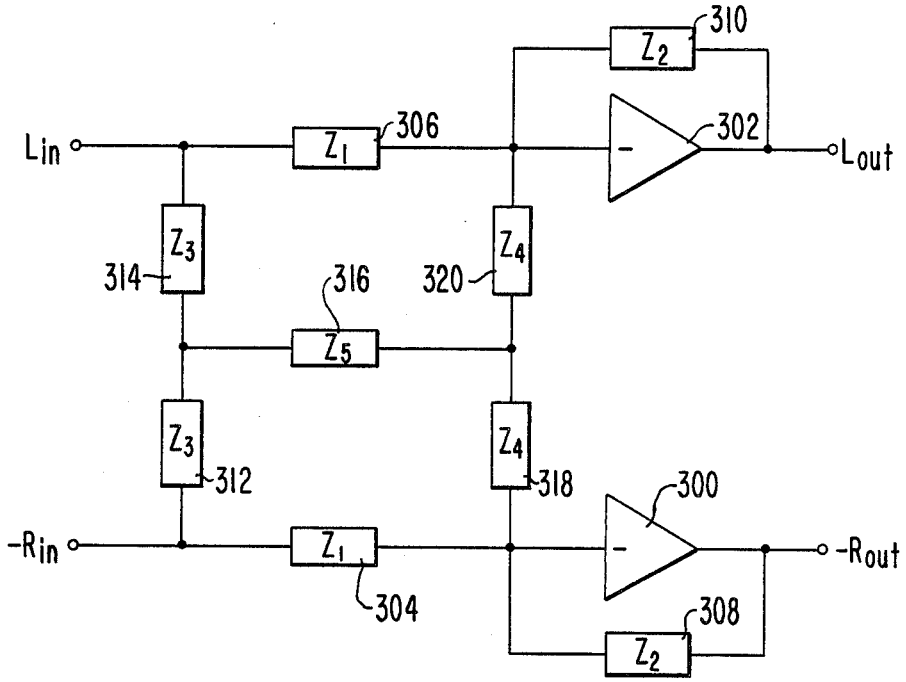
FIG. 4 is a circuit diagram of a practical implementation of the embodiment of FIG. 3, particularly suitable for being built-in in an integrated circuit.

The third embodiment is practically implemented in the circuit of FIG. 4. This comprises two operational amplifiers 300, 302, to the inverting inputs of which the respective signals $-R_{in}$ and $L_{in}$ are applied through respective input impedances 304, 306 having an identical value $Z_1$. To each of the operational amplifiers 300, 302 are coupled in parallel respective impedances 308, 310, having an identical value $Z_2$.

The inputs of the signals $L_{in}$ and $-R_{in}$ are connected to each other by two impedances 312, 314, series coupled, having an equal value $Z_3$, the central node of which is connected, through a further impedance 316 having a value $Z_5$, to the central node of two other impedances 318, 320,series coupled, these also being identical, with a value $Z_4$, which connect to each other the nodes between the impedances 304, 306 and the respective operational amplifiers.

In the implementation of FIG. 4, which is particularly suitable for being built-in in an integrated circuit, the functions of the blocs 218, 220 of FIG. 3 have been assigned respectively to the groups 300, 304, 308, on one side, and 302, 306, 310 on the other. The symmetrical network comprising the impedances 312, 314, 316, 318, 320 is equivalent to the transfer bloc 224 together with the adder means 222, 226, 228.

Each of the impedances $Z_1 \ldots Z_5$ will generally be complex, as an example composed of a capacitor, a resistor, a capacitor and a resistor in parallel, or other combinations, so as to supply the transfer functions A and B necessary to obtain the desired filtering, according to design procedures known to the skilled in the art. In any case all the impedances may be integrated into the circuit, without the use of separate external components, unless the programmability of the expansion base is required, in which case the impedance 316 can be provided externally, and in this case it is preferably composed of a variable, or in any case replaceable, resistor, in order to program the extent of the expansion. If such programmability is not required, the impedance 316 can be a mere short-circuit, since its duties can be served by the four adjacent impedances 312, 314, 318, 320.

Figure 5:
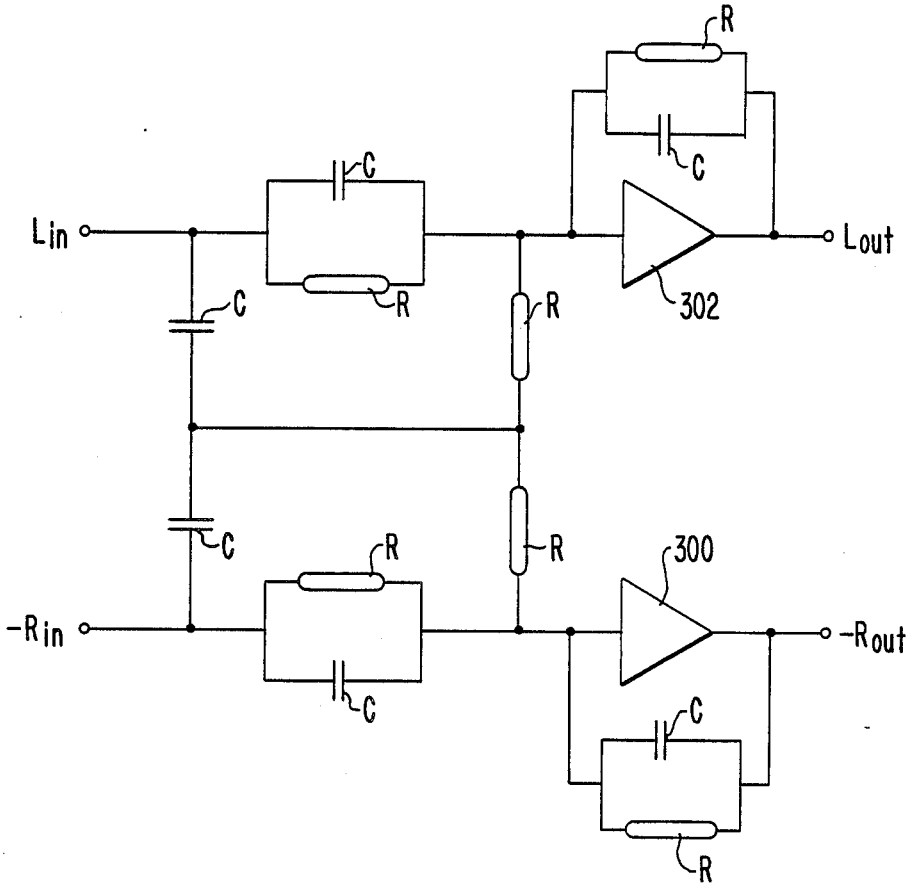
FIG. 5 is a more specific circuit diagram of the implementation of FIG. 4.

In FIG. 5 is illustrated an example of a more specific embodiment of the circuit of FIG. 4, wherein the single impedances have been assigned preferred structures. In this way the impedances 304, 306, 308, 310 are composed of respective parallel couplings of a resistor R and a capacitor C; the impedances 312, 314 are respective capacitors C; the impedances 318, 320 are respective resistors R; and the impedance 316 has become a short circuit. By using appropriate valves, as is known to the skilled in the art, for the single capacitors and resistors, the low-pass and band pass filtering functions described above are obtained.

If the circuit of FIG. 5 is provided in an MOS integrated circuit, in which it is relatively easy to obtain capacitors the values of which have an accurately defined relationship, while it is difficult to obtain resistors having an acceptable precision, all the resistors composing the impedances 304 . . . 320 are preferably simulated with the switched capacitor technique, known in the art. Therefore, the word "resistor", in the specification and the claims, should be understood to refer either to ohmic resistors, or to switched capacitors that are clocked in a way to simulate ohmic resistors, as known to a person skilled in the art.

The preferred embodiments of the invention, described above, are susceptible of equivalent modifications and variations, within the scope of the given teachings, without therewith leaving the scope of the invention.

We claim:

1. A system for expanding the stereo base for a stereophonic acoustic diffusion apparatus, in which first and second input signals, providing together a stereophonic pair, are directly coupled to operational amplifiers via respective series coupled impedances to obtain a first and a second output signal, wherein said operational amplifiers are interconnected by an H-like symmetrical network of impedances having four external branches and a common branch, a first pair of external branches of said H-like network being connected to the respective input signals, and a second pair of external branches of said H-like network being connected to the respective nodes between said series-coupled impedances and the inputs of said operational amplifiers, wherein the impedance in the common branch of said H-like network is a short-circuit.

2. A system according to claim 1, in which the branches of said H-like network receiving said input signals are capacitors.

3. A system according to claim 2, in which the branches of said H connected to the inputs of the operational amplifiers are resistors.

4. A system according to claim 3, in which said series coupled impedances of said operational amplifiers comprise parallel coupled resistors and a capacitors.

* * * * *